United States Patent [19]

Gerardus Van Boxtel

[11] Patent Number: 4,734,292

[45] Date of Patent: Mar. 29, 1988

[54] METHOD OF FORMING VACUUM PACKAGE WITH SMOOTH APPEARANCE

[75] Inventor: I. M. Gerardus Van Boxtel, An Breda, Netherlands

[73] Assignee: Crescent Holding, N.V., Netherlands Antilles

[21] Appl. No.: 913,623

[22] Filed: Sep. 30, 1986

Related U.S. Application Data

[63] Continuation of Ser. No. 725,462, Apr. 22, 1985, abandoned.

[30] Foreign Application Priority Data

May 3, 1984 [EP] European Pat. Off. ..... 84302987.7

[51] Int. Cl.[4] ..... B65B 31/02

[52] U.S. Cl. ..... 426/410; 53/434; 53/449; 426/413; 426/415; 426/316; 426/418; 426/127; 426/124

[58] Field of Search ..... 426/410, 124, 418, 126, 426/127, 316, 415, 413; 53/432–434, 510–512, 449; 383/100, 109, 116

[56] References Cited

U.S. PATENT DOCUMENTS

| | | | |
|---|---|---|---|
| 2,012,213 | 8/1935 | Young | 426/131 |
| 2,135,579 | 11/1938 | Berch | 426/124 |
| 2,216,330 | 10/1940 | Stover . | |
| 2,292,295 | 8/1942 | Royal | 53/434 |
| 2,326,649 | 8/1943 | Howard | 426/124 |
| 2,344,369 | 3/1944 | Salfisberg . | |
| 2,387,812 | 10/1945 | Sonneborn et al. | 53/433 |
| 2,518,100 | 8/1950 | Tomkins | 426/418 |
| 2,542,206 | 2/1951 | Nichols | 426/410 |
| 2,606,704 | 8/1952 | Nichols | 53/434 |
| 2,888,788 | 6/1959 | Gebhardt | 53/434 |
| 2,898,027 | 8/1959 | Scholle . | |
| 3,026,656 | 3/1962 | Rumsey | 53/433 |
| 3,039,882 | 6/1962 | Clinton et al. | 426/418 |
| 3,190,441 | 6/1965 | Rausing . | |
| 3,193,392 | 7/1965 | Lundquist . | |
| 3,204,825 | 9/1965 | Underwood . | |
| 3,248,040 | 4/1966 | Friedman . | |
| 3,299,603 | 1/1967 | Shaw | 53/434 |
| 3,312,337 | 4/1967 | Martin | 426/410 |
| 3,340,669 | 9/1967 | Farquharson | 206/522 |
| 3,469,364 | 9/1969 | Bischoff | 53/433 |
| 3,490,576 | 1/1970 | Alessi et al. | 53/432 |
| 3,494,457 | 2/1970 | Titchenal . | |
| 3,545,983 | 12/1970 | Woods | 53/433 |
| 3,559,800 | 2/1971 | Butler | 206/629 |
| 3,677,774 | 7/1972 | Ravsing | 426/396 |
| 3,745,024 | 7/1973 | Ford et al. | 53/434 |
| 4,172,152 | 10/1979 | Carlisle | 53/434 |
| 4,323,586 | 4/1982 | Long | 53/434 |

FOREIGN PATENT DOCUMENTS

| | | | |
|---|---|---|---|
| 746165 | 7/1970 | Belgium | 426/410 |
| 2143953 | 3/1972 | Fed. Rep. of Germany . | |
| 2364219 | 6/1975 | Fed. Rep. of Germany . | |
| 2364220 | 6/1975 | Fed. Rep. of Germany . | |
| 2531353 | 1/1977 | Fed. Rep. of Germany | 426/412 |
| 2635366 | 2/1978 | Fed. Rep. of Germany | 426/418 |
| 2362769 | 4/1978 | France | 426/410 |
| 2530582 | 1/1984 | France . | |
| 5220199 | 2/1977 | Japan . | |
| 666799 | 2/1952 | United Kingdom | 53/434 |
| 1378140 | 12/1974 | United Kingdom | 426/124 |
| 2085401 | 4/1982 | United Kingdom . | |

OTHER PUBLICATIONS

Food Industries, 9/49, pp. 37,38,190,192.

Modern Packaging, vol. 43, No. 7A, 7/70, p. 147, McGraw Hill.

*Primary Examiner*—Steven Weinstein

*Attorney, Agent, or Firm*—Caesar, Rivise, Bernstein, Cohen & Pokotilow, Ltd.

[57] ABSTRACT

A sealable container (20) includes an inner wall (24) formed of a semipermeable sheet material and shaped into an inner bag (30), an outer wall (26) formed of a gas impermeable sheet material and shaped as an outer bag (32), with a gas space (28) therebetween. A product, e.g. ground coffee (22), is heat sealed under vacuum in the inner bag (30) and gas is introduced into the gas space (28) via openings (56) in the outer bag (32). The container is then heat sealed again to isolate the openings (56) from the gas space (28), to prevent ambient air from gaining ingress to the product. The finished package has a smooth exterior appearance.

4 Claims, 4 Drawing Figures

FIG. 1
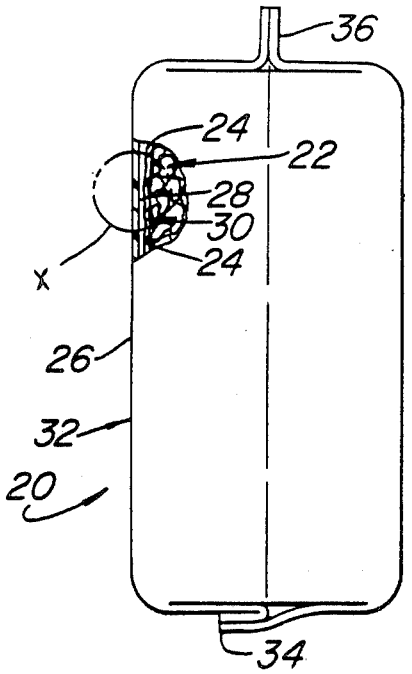
FIG. 2
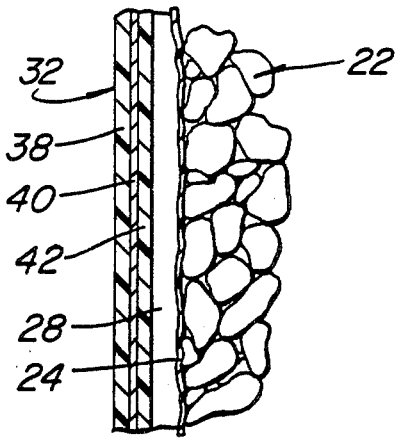
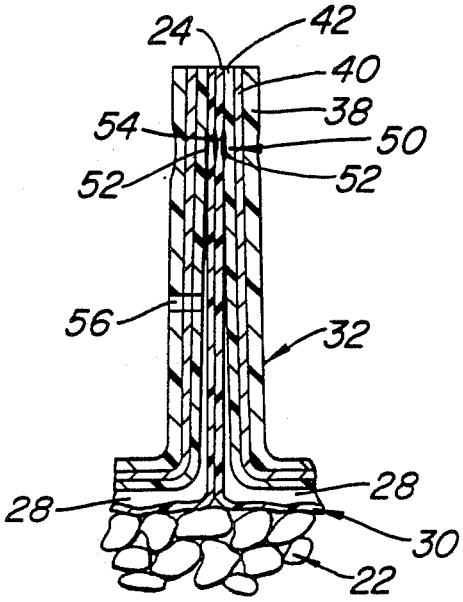
FIG. 3
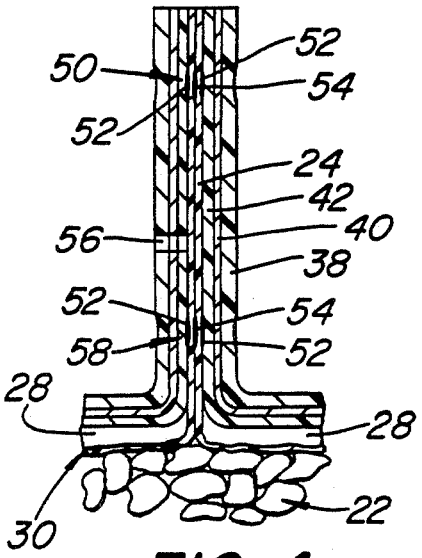
FIG. 4

METHOD OF FORMING VACUUM PACKAGE WITH SMOOTH APPEARANCE

This application is a continuation of application Ser. No. 725,462, filed Apr. 22, 1985, now abandoned.

This invention relates to containers, and more particularly, to containers to be formed into packages containing foodstuffs and to methods of making the same.

Conventional flexible vacuum packaging for air perishable foodstuffs and like products comprises containers formed of a multi-layer sheet material, such as plastic and foil. The materials forming layers of the container are selected for strength and to maintain the vacuum to prevent the ingress of air into the container. If the contents of the container are of a particulate nature, such as ground coffee, the vacuumization of the container to seal the coffee therein results in the formed package having an uneven, rough or pebbly appearance as it conforms to the particulate surface of the contents. To conceal the unsightly appearance it is a common practice to overwrap the vacuum container in a bag or covering of paper. The overwrapping paper is printed with the desired legend, e.g. graphics and text. Since the paper covering or wrapping is not under vacuum the package has a generally smooth outer surface. The paper overwrap is readily susceptible to damage, e.g. tearing or erosion, etc., thereby spoiling the appearance of the package. Also, the paper overwrap may become wrinkled, which will impair the appearance of the package.

One alternative technique makes use of an outer wrapper or overwrapper of foil which carries printing on its exterior surface. While such a construction is more resistant to damage, it is significantly more expensive to produce. Also, the printing on the foil overwrapper is still susceptible to abrasion, which can decrease the attractiveness of the package.

Another techique uses a single, thicker walled container formed of many layers, e.g., three or more, so that when the flexible material wall conforms to the contents within the package it takes less of the rough surface appearance of the enclosed product than is the case of thinner walled packages. While this alternative construction provides a package which is better in appearance, it still leaves much to be desired.

It is one object of this invention to provide a container for use in forming a package holding products under vacuum and which exhibits an attractive and smooth surface appearance.

According to one aspect of the invention, there is provided a package comprising a container (20) having contents (22) vacuum sealed therein, the container having a bag (32) formed of a wall (26) which is substantially impermeable to air characterised in that the container (20) includes an inner bag (30) formed of a wall (24) and in that the bags (30, 32) are separated by a gas space (28) containing a gas which is not deleterious to the contents (22).

Most preferably the bag of the outer wall includes at least one opening for enabling a gas to be introduced into the gas space. Most preferably the inner bag is formed from a wall which is gas semipermeable.

The outer bag is sealable to isolate the gas space from the ambient atmosphere and is preferably formed of a multilayered material rendering it substantially gas impermeable.

The use of the double walled or bagged container, with the inner wall being formed of a semipermeable material, with the outer bag formed of an air impermeable material and separated from the inner bag by a gas space ensures that the outermost wall remains smooth in appearance after vacuumization of the product within the container, notwithstanding that the product has a rough surface. In accordance with the method of forming the container, the container, with the product located within the inner bag, is placed under vacuum. The inner bag is heat sealed to seal the product within it under vacuum. A suitable gas is thereafter introduced through the opening in the outer wall into the gas space. The outer bag is sealed to isolate the gas space from the ambient atmosphere, thus completing the package.

In order that the invention may be well understood, it will now be decided by way of example, with reference to the accompanying diagrammatic drawings, in which:

BRIEF DESCRIPTION OF THE DRAWINGS

FIG. 1 is a side elevation of a sealed package of the invention;

FIG. 2 is an enlarged section of the portion of the package shown within the marked X in FIG. 1;

FIG. 3 is an enlarged section of the mouth of the container shown in FIG. 1 before final sealing; and FIG. 4 is a view, similar to that of FIG. 3, but showing the sealed container.

The package of FIG. 1 comprises a container 20 which includes an inner wall 24, and outer wall 26 and a space 28 therebetween. The inner wall comprises an inner bag 30 in which the particulate material, e.g. ground coffee, 22, is disposed. The outer wall 26 is shaped to define an outer bag 32. The inner bag 30 is located within the outer bag 32 and the bags are connected at the bottom along a marginal flap or seam 34 and at the top or mouth 36 as will be described later.

The outer wall 26 is formed of a sheet material which is strong, tough, and substantially impermeable to the passage of gas, e.g. air, to keep the product under vacuum and prevent it from being exposed to the deleterious effects of the ambient atmosphere. In accordance with the preferred embodiment of the invention, and as shown clearly in FIG. 2, the wall 26 is formed of three layers comprising an outer layer 38, formed of a transparent plastic material, e.g., biaxially oriented polypropylene or biaxially oriented polyester, a middle layer 40, formed of a metal, e.g. aluminium foil and an inner layer 42 formed of a plastic material, e.g. polyethylene.

The graphics, text or artwork, etc. for the package is printed in reverse on the inner surface of the outer layer 38 and is thus clearly visible through the transparent outer layer 38. By its strength the outer layer 38 protects the printing from erosion or other damage, thereby insuring the package maintains its good looking appearance over time.

Because the outer bag 32 is made of an outer wall 26 which is impermeable to gas, the sheet material making up the inner bag 30 need not be completely gas impermeable to maintain the vacuum in the package. Thus, the sheet making up the inner wall 28 may be formed of a lower cost, semipermeable flexible plastic material which is heat sealable to the inner layer of the outer wall and to itself, e.g. polyethylene.

A gas is located within the gas space 28 and sufficient is present to space the outer wall 26 from the inner wall 24 and to maintain the smooth appearance of the outer wall despite the fact that the surface appearance of the inner bag 30 is rough or pebbly because of the vacuum sealed particulate material 22. Any gas can be utilized in the gas space 28, provided that the gas does not adversely affect the product held within the inner bag. Thus the gas should be non-deleterious or inert with respect to the contents of the inner bag 30. When used to package coffee, the gas located within the gas space 28 is preferably nitrogen which may be mixed with the naturally occurring gases generated when coffee beans are ground. The use of nitrogen has been found to reduce the tendency for carbon dioxide gases to be released naturally by the coffee within the container during prolonged storage.

The formation and sealing of the package is best understood by reference to FIGS. 3 and 4. The inner bag 30 is filled with the product 22, and with the mouth 36 open (unsealed), is passed to the vacuum sealing chamber (not shown) of a conventional vacuum sealing machine (not shown). A vacuum is drawn to evacuate all of the air from the container 20. A pair of heated jaws (not shown) of the machine form a heat seal line 50 (FIG. 3) across the entire width of the mouth of the container. This action seals the outer container to the inner bag 30 at the interfaces 52 and seals the abuting surfaces of the inner bag to each other at the interface 54. The contents 22 are totally sealed within the inner bag 30.

As can be clearly seen in FIG. 3, the outer wall 26 includes an opening or port 56 in the portion forming the mouth 36. The port 56 is located below the heat seal line 50 and communicates with the interior of the gas space 28 but not with the interior of the inner bag 30. After the container 20 is sealed along line 50 and while the machine's chamber is under vacuum a suitable gas is introduced into the chamber, whereupon the gas flows through the port 56 into the gas space 28. When the gas has stabilized, that is when the gas pressure within the gas space 28 is equal to the gas pressure within the chamber, the container 20 is removed and the mouth immediately heat sealed again to form the sealed package. As can be seen in FIG. 4, in this step the mouth 36 is heat sealed along a second heat seal line 58, similar to line 50, but located below the port 56. This action seals the inner bag 30 within the gas impermeable outer bag 32 and thus isolates the gas filled space 28 from the ambient atmosphere.

The marginal or free end of the sealed mouth 36 can be folded or optionally trimmed away below the port 56 but above the lower heat seal line 58 to improve appearance.

The specific materials making up the container 20 are not critical, provided that the outer bag of the container is constructed of gas impermeable material and the inner bag is constructed of a material that is at least gas semipermeable. Thus, the inner and outer walls can be formed of single or plural layers of combinations of plastic and/or foil, etc.. The package is simple in construction, yet provides a very attractive smooth appearance which is resistant to abrasion or degradation and is simple and relatively inexpensive to make and seal. The introduced gas may be nitrogen or other suitable gas, and the gas space may be made up of one or more compartments which may be interconnected. The opening to the gas space may be a hole or slit or of any other suitable configuration.

I claim:

1. A method of forming a container for a packaged foodstuff, said container comprising an inner bag formed of an inner wall material which is at least gas semi-permeable, an outer bag joined to the inner bag and formed of an outer wall material which is substantially impermeable to air and a gas space therebetween, said outer bag having an upper edge and a port spaced downwardly from said upper edge, said port being in communication with said gas space, said inner bag being filled with said foodstuff, said method comprising the steps of:

providing said inner bag in said outer bag, with said inner bag having an open mouth and being filled with said foodstuff; drawing a vacuum in said inner bag; sealing said inner bag to said outer bag and sealing said inner bag closed, both in a location above said port to seal said foodstuff in said inner bag under vacuum; and thereafter introducing a gas which does not adversely effect said foodstuff into said gas space through said port; and thereafter simultaneously sealing said outer bag to said inner bag and sealing said inner bag closed in a location below said port for isolating the gas space from said port and ambient atmosphere so that said gas disposed in said gas space remains in said gas space and is in an amount sufficient to provide a smooth outer surface for said package.

2. The method of claim 1 wherein the steps of simultaneously sealing said inner bag closed and sealing said outer bag to said inner bag both above and below said port are carried out by heat sealing.

3. The method of 1 including the additional step of removing an upper section of the container at a location between said port and the seal below said port for improving the appearance of said container.

4. The method of claim 1, wherein said step of sealing said inner bag to said outer bag and sealing said inner bag closed, both in a location above said port occurs simultaneously.

* * * * *